US007946093B1

(12) United States Patent
Sturino

(10) Patent No.: US 7,946,093 B1
(45) Date of Patent: May 24, 2011

(54) HEIGHT-ADJUSTABLE TILE SPACERS

(76) Inventor: Antonio Sturino, Mississauga (CA)

( * ) Notice: Subject to any disclaimer, the term of this patent is extended or adjusted under 35 U.S.C. 154(b) by 239 days.

(21) Appl. No.: 12/291,268

(22) Filed: Nov. 7, 2008

(51) Int. Cl.
*E04F 21/20* (2006.01)
*E04F 21/18* (2006.01)
*G01B 3/00* (2006.01)

(52) U.S. Cl. ..... 52/749.11; 33/527

(58) Field of Classification Search ..... 52/396.1, 52/745.11, 749.11, 553, 126.4, 126.7; 33/527, 33/526
See application file for complete search history.

(56) References Cited

U.S. PATENT DOCUMENTS

| | | | | | |
|---|---|---|---|---|---|
| 2,031,684 | A | | 2/1936 | Berger | |
| 2,797,495 | A | | 7/1957 | Walston | |
| 2,930,135 | A | | 3/1960 | Rodtz, Sr. | |
| 2,963,131 | A | * | 12/1960 | Brockway | 52/126.4 |
| 3,010,213 | A | | 11/1961 | Rodtz, Sr. | |
| 3,735,497 | A | | 5/1973 | Boettcher | |
| 4,503,654 | A | * | 3/1985 | Cosentino | 52/747.11 |
| 4,793,068 | A | | 12/1988 | Golkar | |
| 4,953,341 | A | | 9/1990 | Joos | |
| 4,955,142 | A | | 9/1990 | Rieck | |
| 5,201,130 | A | | 4/1993 | Krchnak | |
| 5,288,534 | A | | 2/1994 | Tavshanjian | |
| 5,359,783 | A | | 11/1994 | Smith | |
| 5,479,745 | A | * | 1/1996 | Kawai et al. | 52/126.6 |
| 5,542,219 | A | * | 8/1996 | Dias | 52/126.4 |
| 5,623,799 | A | | 4/1997 | Kowalski et al. | |
| 5,701,680 | A | * | 12/1997 | Garcia et al. | 33/526 |
| 6,385,858 | B1 | | 5/2002 | Muller | |
| 6,647,685 | B2 | * | 11/2003 | Annarella et al. | 52/392 |
| D492,210 | S | | 6/2004 | Shilo et al. | |
| 6,796,049 | B1 | | 9/2004 | Claxton | |
| 6,874,242 | B2 | | 4/2005 | Shilo et al. | |
| 6,941,710 | B2 | * | 9/2005 | Eden | 52/170 |
| 7,257,926 | B1 | * | 8/2007 | Kirby | 52/126.5 |
| 7,454,869 | B2 | * | 11/2008 | Owen | 52/263 |
| 7,607,264 | B2 | * | 10/2009 | Weber | 52/169.9 |
| 7,621,100 | B2 | * | 11/2009 | Kufner et al. | 52/749.11 |
| 7,694,670 | B2 | * | 4/2010 | Smith | 125/23.01 |
| 2002/0121027 | A1 | | 9/2002 | Kruskamp | |
| 2008/0141617 | A1 | * | 6/2008 | Joski | 52/749.11 |

* cited by examiner

*Primary Examiner* — Brian E Glessner
*Assistant Examiner* — Beth Stephan
(74) *Attorney, Agent, or Firm* — Montgomery Patent and Design; Robert C. Montgomery

(57) ABSTRACT

A system to aid in the setting of tile work comprising tile spacers located at the corner of a tile to keep a tile evenly spaced from other tiles. The tile spacers each comprise a circular-shaped disk with integrally-molded spacer tabs in a variety of orientations, thus allowing use of the spacer against another wall, in a corner or a similar location. Each tile spacer is designed to remain in place after the tile is set and be covered with grout, thus making it invisible after the installation is complete. Finally, the tile spacer is provided with a threaded center hole designed to accommodate a threaded stem with permanently attached wing nut. The user can then tighten or loosen the bolt to raise or lower the tile spacer and subsequently the adjacent tile to an equal elevation. The threaded stem is simply removed after the tile has set, making for an invisible and effective installation.

14 Claims, 6 Drawing Sheets

HEIGHT-ADJUSTABLE TILE SPACERS

RELATED APPLICATIONS

The present invention was first described in an Official Record of Invention filed on Sep. 21, 2007, the entire disclosure of which is incorporated herein by reference thereto.

FIELD OF THE INVENTION

The present invention relates generally to a spacer for use in setting tiles and, more specifically, to a spacer for use in setting tiles that has the ability to adjust the height of the tile during setting; further comprising circular-shaped disks having a plurality of "X", "T" and "I"-shaped spacer tabs with a threaded center hole designed to accommodate a threaded screw with a permanently attached wing nut, thereby enabling a user to raise or lower the spacer and subsequently the adjacent tile to an equal elevation.

BACKGROUND OF THE INVENTION

It is prevalent for ceramic tile installers to utilize a tile spacer in order to obtain a consistent gap distance between the tiles. Conventional tile spacers do not adjust for differences in the elevation of the subfloor below the tile. The height adjustable tile spacer addresses and solves this problem.

Installing tile flooring is a challenging task due to the individual pieces requiring precise cuts and the need to achieve a perfect, consistent pattern during the installation. Part of the challenge is the spacing between each tile section which will later allow for grout to be installed. Plastic spacers can be set to aid in this process, but they must be moved individually when the next piece is to be installed. Additionally, the plastic only allows for one dimension to be set at a time, thus multiple spacers must be set for just one (1) piece of tile. This practice will result in the user trying to juggle the tile along with several spacers with less than satisfactory results. Finally, such spacers only adjust for the width of the grout line and do nothing for leveling the height of the tile over an uneven subfloor. In this circumstance, the user must repeatedly use the "apply, tap, remove" process until the tile is just right. While these problems are difficult for the professional tile installer, they prove to be almost insurmountable for the do-it-yourselfer. Accordingly, a need has developed for a device that overcomes the problems associated with establishing consistent spacing and elevation when setting tiles on floors. The tile spacer herein described fulfills this need.

Several attempts have been made in the past to invent tile spacers. U.S. Pat. No. D 492,210 issued to Shilo discloses a tile spacer that appears to be a hexagonal shaped spacer with a central opening. Unfortunately, this design patent does not appear to disclose a device similar in appearance to the spacer described herein, nor does it appear to comprise a centrally-threaded screw with an attached wing nut to elevate the tile.

U.S. Pat. No. 6,874,242 issued to Shilo discloses a dual spacing width tile spacer that is square in configuration and comprises a circular central opening. Unfortunately this patent does not appear to disclose a height adjustable tile spacer that comprises a circular spacer with a plurality of spacer tabs and a centrally-threaded screw with a permanently mounted wing nut.

U.S. Pat. No. 6,796,049 issued to Claxton discloses an adjustable tile spacing device that appears to be four tile spacers set on an adjustable frame to consistently space the tiles. Unfortunately, this device does not appear to disclose a height adjustable tile spacer with a centrally threaded screw to permit elevation of the tile to adjust for differences in the subflooring beneath the tile.

U.S. Pat. No. 6,385,858 issued to Muller appears to disclose a spacing tool comprising a pair of intersecting planes. Unfortunately this patent does not appear to disclose a height adjustable tile spacer comprising a circular spacer with an internally-threaded aperture that accepts a centrally-threaded screw to adjust the elevation of the tile.

U.S. Pat. No. 5,623,799 issued to Kowalski discloses a device and process for aligning exterior faces of tiles of irregular thickness when mounting said tiles. Unfortunately this patent does not appear to disclose a height adjustable tile spacer comprising a circular spacer disk comprising a plurality of spacer tabs with a threaded aperture to accept a centrally-threaded screw with an attached wing nut.

U.S. Pat. No. 5,359,783 issued to Smith discloses a tile spacer for simultaneously aligning tiles along their width during setting that appears to comprise a spacer with four (4) legs set at ninety degree (90°) angles and a perpendicular handle. Unfortunately this patent does not appear to disclose a height adjustable tile spacer comprising a centrally-threaded screw with attached wing nut that is adjustable through a circular disk to adjust the elevation of a time during setting.

U.S. Pat. No. 5,288,534 issued to Tayshanjian discloses a circular platform upon which rest on one side a cross-shaped spacer and on the other side a tee-shaped spacer. Unfortunately this patent does not appear to disclose a tile spacer that adjusts the elevation of a tile during setting utilizing a circular spacer disk with a threaded aperture through which a centrally-threaded screw moves nor does it appear that this device is designed to permit the permanent installation of the circular platform.

U.S. Pat. No. 5,201,130 issued to Krchnak appears to disclose a tile template that comprises a plurality of arms disposed a various angles to maintain equidistant spacing between tiles. Unfortunately this patent does not appear to disclose a tile spacer comprising a circular spacer disk with a plurality of tabs and a centrally threaded screw with attached wing nut that cooperate to adjust the elevation of a tile to correct any unevenness in the sub flooring structure.

U.S. Pat. No. 4,955,142 issued to Rieck discloses a deck spacing tool that appears to comprise a vertically extending blade with a pair of horizontally extending arms. Unfortunately this patent does not appear to disclose a tile spacer that comprises a circular spacer disk capable of being manipulated in a manner so as to bring a tile into a level configuration during tiling.

U.S. Pat. No. 4,953,341 issued to Joos discloses a single piece spacer for laying tile comprising a plurality of legs extending from a common juncture. Unfortunately this patent does not appear to disclose a tile spacer with a centrally threaded aperture that accepts a threaded screw with an integral wing nut to adjust a tile during tiling in a vertical manner.

U.S. Pat. No. 4,793,068 issued to Golkar discloses a spacer with a plurality of configurations that comprise arms that provide for even spacing of tiles during tiling. Unfortunately this patent does not appear to disclose a height adjustable tile spacer comprising a circular spacer disk with a plurality of spacer tabs located thereon and a threaded screw that adjusts the vertical elevation of a tile during tiling.

U.S. Pat. No. 3,735,497 issued to Boettcher discloses a flooring spacer that comprises a head that may be grasped manually by a tongue that inserts into the void. Unfortunately this patent does not appear to disclose a height adjustable tile spacer.

U.S. Pat. No. 3,010,213 in the name of Rodtz discloses a tile spacer. Unfortunately this patent does not appear to disclose a height adjustable tile spacer.

U.S. Pat. No. 2,930,135 in the name of Rodtz discloses a tile setting gauge. Unfortunately this patent does not appear to disclose a height adjustable tile spacer.

U.S. Pat. No. 2,797,495 in the name of Walston discloses a glass building block aligner. Unfortunately this patent does not appear to disclose a height adjustable tile spacer.

U.S. Pat. No. 2,031,684 in the name of Berger discloses a tile spacer. Unfortunately this patent does not appear to disclose a height adjustable tile spacer.

U.S. Patent Application Number 2002/0121027 in the name of Kruskamp discloses a device and method for spacing tiles. Unfortunately this patent does not appear to disclose a height adjustable tile spacer.

None of the prior art particularly describes a spacer that can be used to evenly space tiles during setting and that adjusts for differences in elevation of the subflooring. Accordingly, there exists a need for a height adjustable tile spacer comprised of a circular disk with spacer tabs located thereon and a centrally threaded screw that operates without the disadvantages as described above.

SUMMARY OF THE INVENTION

In view of the foregoing disadvantages inherent in the prior art, it has been observed that there is a need for a tile spacer that achieves a consistent spacing between tiles and permits the installer to elevate the tile to provide a leveled finished product during installation.

It is an object of the height adjustable tile spacer to provide the user with a consistent equidistant gap between tiles during installation.

Another object of the height adjustable tile spacer is to provide the user with the ability to adjust the elevation of the tile during placement so as to achieve a level installation.

A further object of the height adjustable tile spacer is to be introduced in a variety of alternate embodiments so as to conform to a variety of tile joint configurations.

Still another object of the height adjustable tile spacer is a central circular disk that remains permanently in place in the adhesive grout layer between the tile joints thereby providing an invisible and consistent flooring installation.

An aspect of the height adjustable tile spacer comprises a spacer disk with at least one (1) spacer tab, a stem aperture, and a threaded stem with a winged head. The spacer tabs and first stem aperture are molded onto the spacer disk at the time of fabrication. The spacer disk further comprises a first stem aperture located at the center of the spacer disk which is threaded.

Another aspect of the height adjustable tile spacer comprises a spacer disk with four (4) spacer tabs each equidistantly oriented at a ninety degree (90°) angle from each adjacent spacer tab.

A further aspect of the height adjustable tile spacer comprises a threaded stem with a winged head. The winged head portion of the threaded stem is similar in appearance to a wing nut and is permanently attached during the injection molding process. The winged head portion of the threaded stem permits the user to digitally manipulate the threaded stem. The threaded stem threadably attaches to the spacer disk through the stem aperture and as the threaded stem is turned by the user in a clockwise manner, the lower portion of the threaded stem extends beyond the bottom surface of the spacer disk.

Yet another aspect of the height adjustable tile spacer comprises, in an alternate embodiment, a second height adjustable tile spacer comprising a second spacer disk with two (2) spacer tabs. The second spacer disk further comprises two (2) second spacer tabs equidistantly oriented at a one hundred and eighty (180°) degree angle from each other.

A further aspect of the height adjustable tile spacer comprises, in an alternate embodiment, a third height adjustable tile spacer comprising a third spacer disk with three (3) spacer tabs. The three (3) spacer tabs are oriented in a "T"-shaped configuration on the upper surface of the third spacer disk.

Yet another aspect of the height adjustable tile spacer provides for tile spacer tabs that abut against edges of the tile to provide a horizontal level tile surface, thereby providing a level means for vertically adjusting the tiles.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
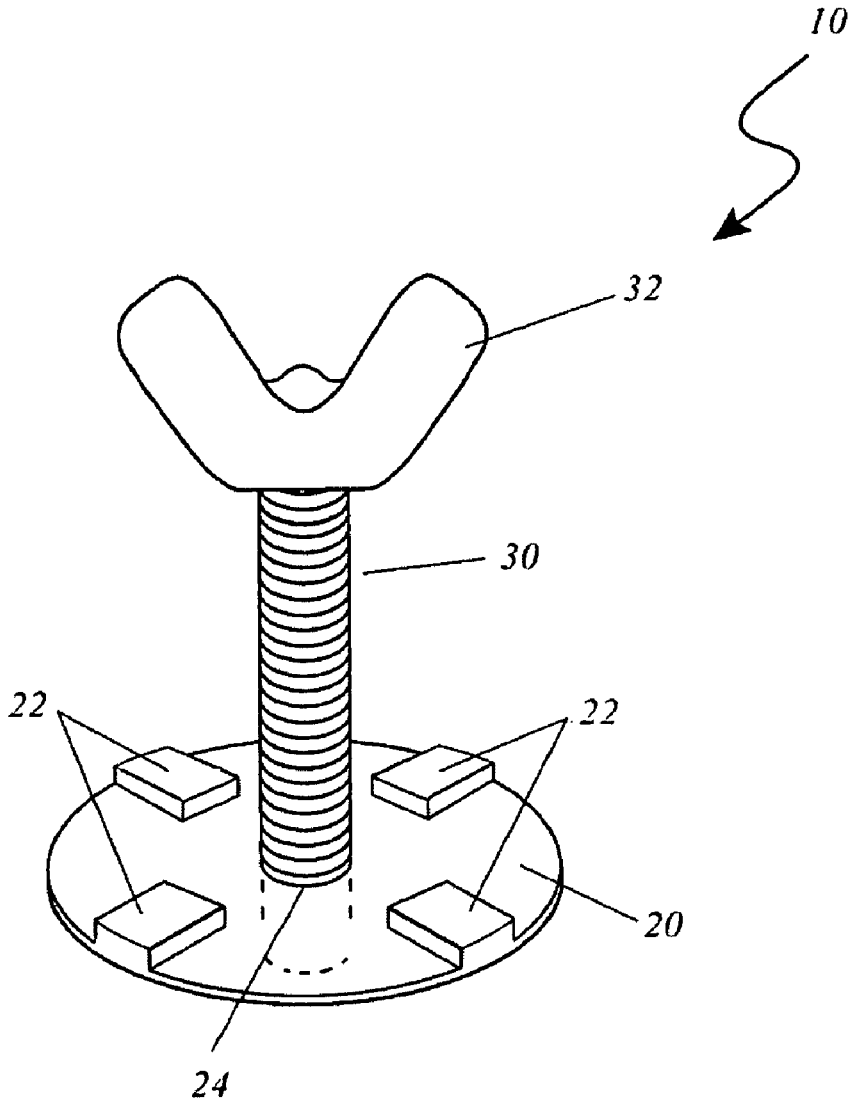
FIG. 1 is a front perspective view of a first height adjustable tile spacer 10, according to a preferred embodiment of the present invention.

10 first height adjustable tile spacer
20 first spacer disk
22 first spacer tab
24 first stem aperture
30 threaded stem
32 winged head
40 second height adjustable tile spacer
42 second spacer disk
44 second spacer tab
46 second stem aperture
60 third height adjustable tile spacer
62 third spacer disk
64 third spacer tab
66 third stem aperture
80 square tile
81 rectangular tile
90 adhesive layer
100 baseboard

110 subfloor
120 spacing gap

DETAILED DESCRIPTION OF THE PREFERRED EMBODIMENT

The best mode for carrying out the invention is presented in terms of its preferred embodiment, herein depicted within FIGS. 1 through 7. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a system and method for a height-adjustable tile spacer (herein described as the "system"), which provides a means for installing a plurality of floor tiles creating a consistent equidistant gap by use of a spacer tab and an equal elevation by raising and lowering a spacer disk. The system will be introduced with a variety of alternate embodiments comprising a first height adjustable tile spacer 10, a second height adjustable tile spacer 40, and a third height adjustable tile spacer 60 envisioned to be used in a variety of tile joint configurations. The system will remain in the adhesive layer between the tile joints when the floor is grouted providing an invisible and consistent installation.

Referring now to FIG. 1, a front perspective view of the system, according to the preferred embodiment of the present system, is disclosed. The first height adjustable tile spacer 10 comprises a spacer disk 20 preferably made of a rigid plastic material fabricated in a common plastic injection molding process or the like envisioned to be approximately three fourths (¾) inch diameter and one eighth (⅛) inch thick. The first spacer disk 20 will comprise four (4) first spacer tabs 22 each positioned equidistant at a ninety degree (90°) angle from an adjacent first spacer tab 22. The spacer disk 20 further comprises a first stem aperture 24 located at the center of said spacer disk 22 envisioned having a threaded inner surface. The first spacer tabs 22 and the first stem aperture 24 are preferably molded as part of the spacer disk 20 during the plastic molding process. The tile spacers 10, 40, 60 also comprises a threaded stem 30 preferably made of a rigid plastic fabricated through a common injection molding process or the like. The threaded stem 30 comprises a winged head 32 envisioned to be a similar to a wing nut which is permanently fastened to said stem 30 during the injection molding process and allows a user to digitally manipulate said threaded stem 30.

Figure 2:
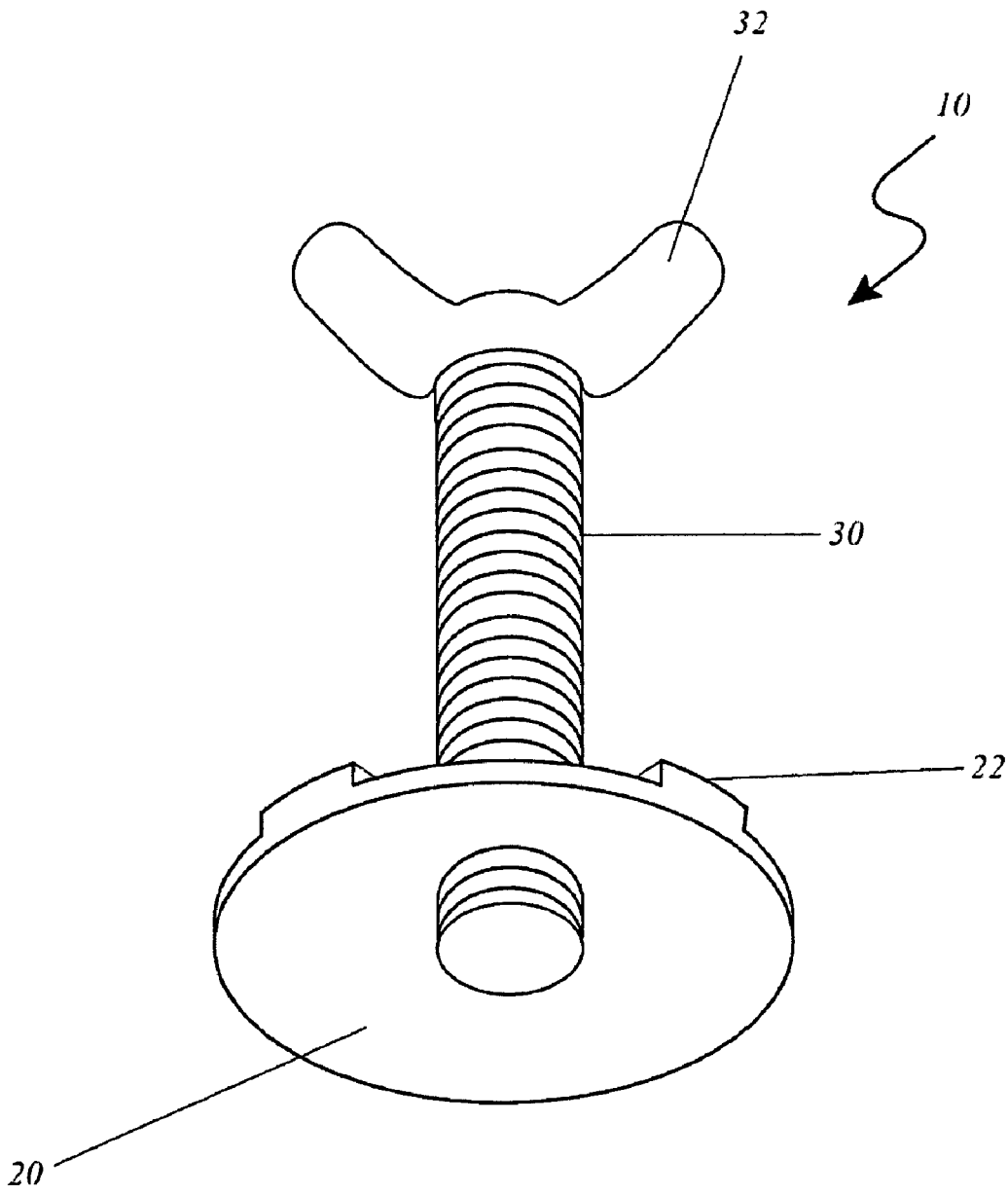
FIG. 2 is an upwardly looking view of a first height adjustable tile spacer 10, according to a preferred embodiment of the present invention.

Referring now to FIG. 2, an upward looking view of the first height adjustable tile spacer 10, according to the preferred embodiment of the present system, is disclosed. The threaded stem 30 is envisioned to threadably attach to the spacer disk 20 therethrough the stem aperture 24. As the threaded stem 30 is turned clockwise by the winged head 32 a lower portion of said threaded stem 30 will extend beyond the bottom surface of the spacer disk 20. The threaded stem 30 is of the same width as the spacer tabs 22, 44, 64 located on the spacer disks 20, 42, 62.

Figure 3:
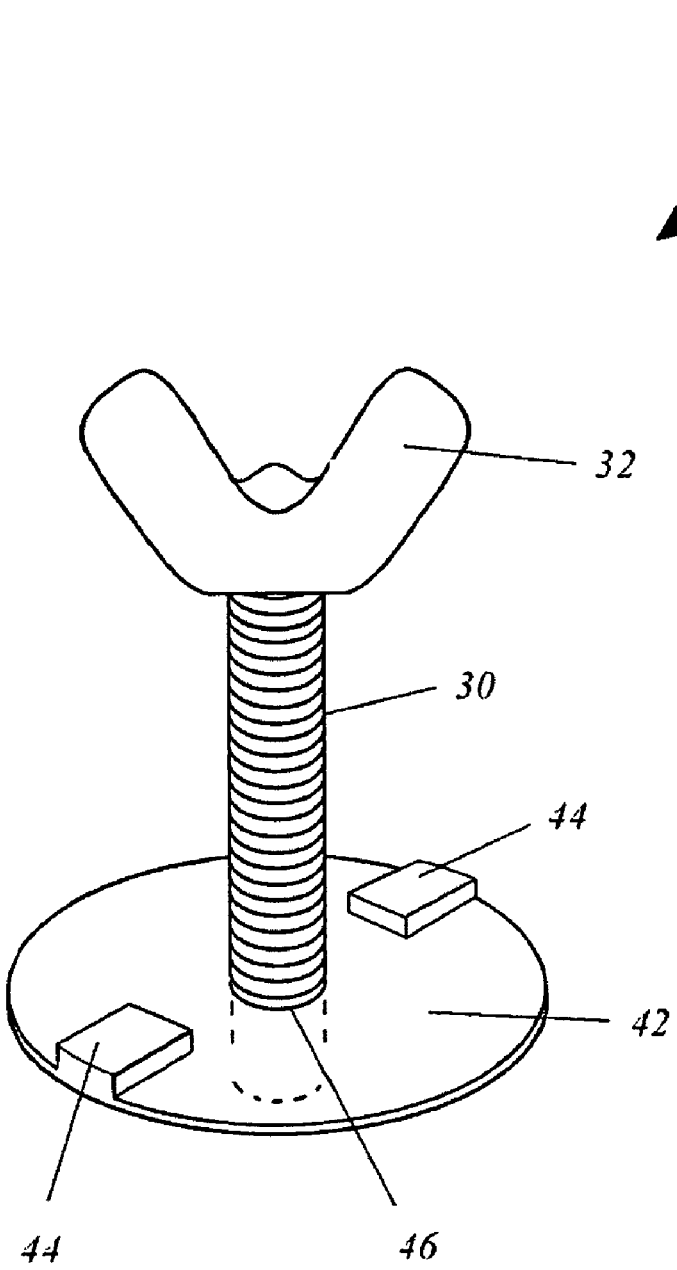
FIG. 3 is a front perspective view of a second height adjustable tile spacer 40, according to an alternate embodiment of the present invention.

Referring now to FIG. 3, a front perspective view of the second height adjustable tile spacer 40, according to an alternate embodiment of the present system, is disclosed. The second height adjustable tile spacer 40 comprises a second spacer disk 42 which comprises two (2) second spacer tabs 44 and a second stem aperture 46 which act in a similar manner to the preferred embodiment of the system. The second spacer tabs 44 are each positioned equidistant at a one hundred eighty degree (180°) angle from an adjacent second spacer tab 44.

Figure 4:
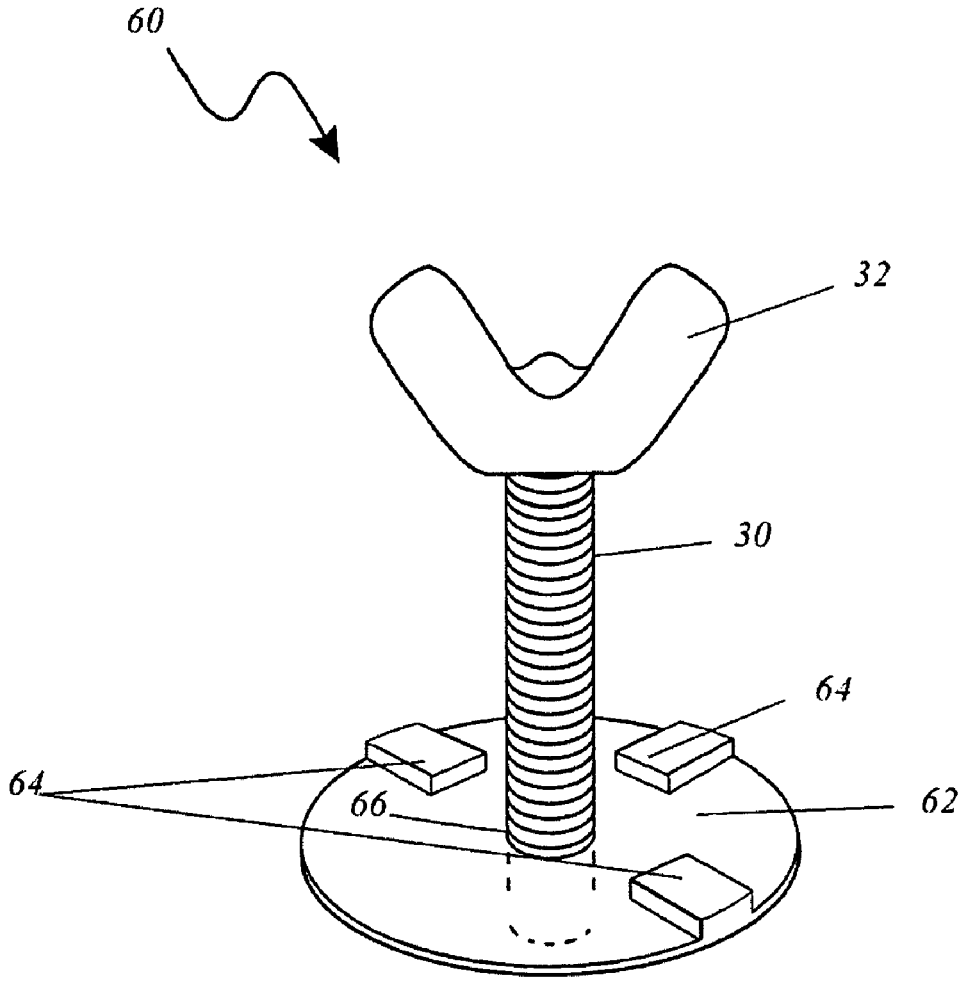
FIG. 4 is a front perspective view of a third height adjustable tile spacer 60, according to an alternate embodiment of the present invention.

Referring now to FIG. 4, a front perspective view of the third height adjustable tile spacer 60, according to an alternate embodiment of the present system, is disclosed. The third height adjustable tile spacer 60 comprises a third spacer disk 62 which comprises three (3) third spacer tabs 64 and a third stem aperture 66 which act in a similar manner to the preferred embodiment of the system. The third spacer tabs 64 are positioned in a "T"-shape where two (2) tabs 64 are equidistant at a one hundred degree (180°) angle from one another and equidistant at a ninety degree (90°) angle from the third adjacent spacer tab 64.

Figure 5:
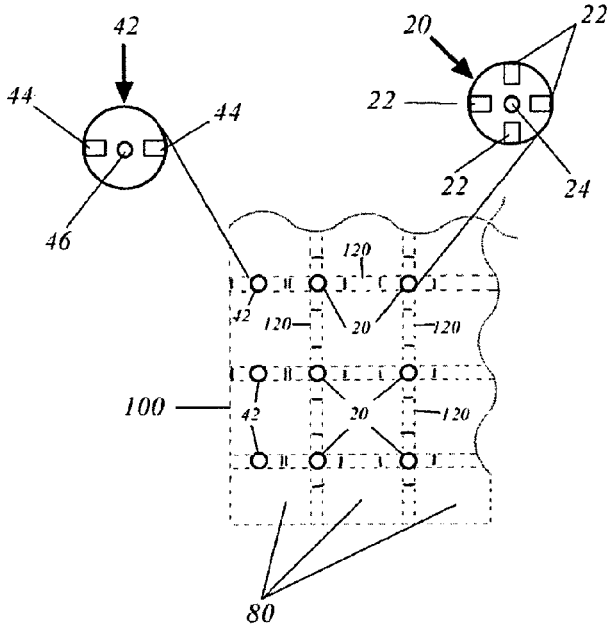
FIG. 5 is a plan view of a plurality of height adjustable tile spacers 20, 42 of the type shown in FIGS. 1 through 3 and a number of square tiles 80 in an aligned position along a baseboard 100, according to a preferred embodiment of the present invention.
Figure 6:
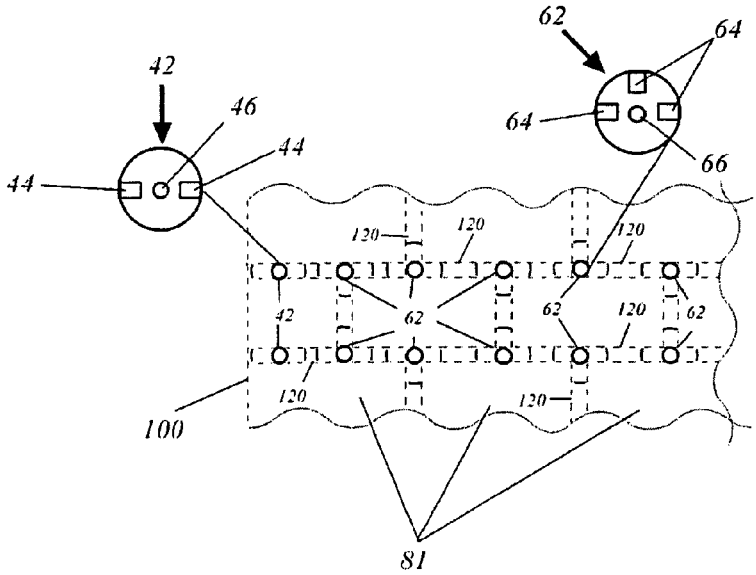
FIG. 6 is a plan view of a plurality of height adjustable tile spacers 42, 62 of the type shown in FIGS. 3 and 4 and a number of rectangular tiles 81 in a staggered position along a baseboard 100, according to an alternate embodiment of the present invention; and, FIG. 7 is an environmental view of a height adjustable tile spacer 10, according to a preferred embodiment of the present invention.

Referring now to FIG. 5, a plan view of a plurality of height adjustable tile spacers 20, 42 of the type shown in FIGS. 1 through 3 and a number of square tiles 80 in an aligned position along a baseboard 100, according to the preferred embodiment of the present system, is disclosed. FIG. 5 and FIG. 6 both show a plurality of height adjustable tile spacers 20, 42 with the threaded stem 30 removed for purposes of clarity and illustration. The first tile spacers 20 are located at the corner joints of the square tiles 80 and the second tile spacers 42 are located between the square tiles 80 at the baseboard 100. The spacer tabs 24, 44 are envisioned having a predetermined width providing an appropriate spacing gap 120 between adjacent square tiles 80.

Referring now to FIG. 6, a plan view of a plurality of height adjustable tile spacers 42, 62 of the type shown in FIGS. 3 and 4 and a number of rectangular tiles 80 in a staggered position along a baseboard 100, according to an alternate embodiment of the present system, is disclosed. The third tile spacers 62 are located at the corner joints of the rectangular tiles 81 and the second tile spacers 42 are located between the rectangular tiles 81 at the baseboard 100. The spacer tabs 44, 64 are envisioned having a predetermined width providing an appropriate spacing gap 120 between adjacent rectangular tiles 81. The third spacer disk 62 may be positioned slightly away from a wall or a baseboard 100 in order to maintain a clean finished look and to elevate tiles near a wall surface.

Figure 7:
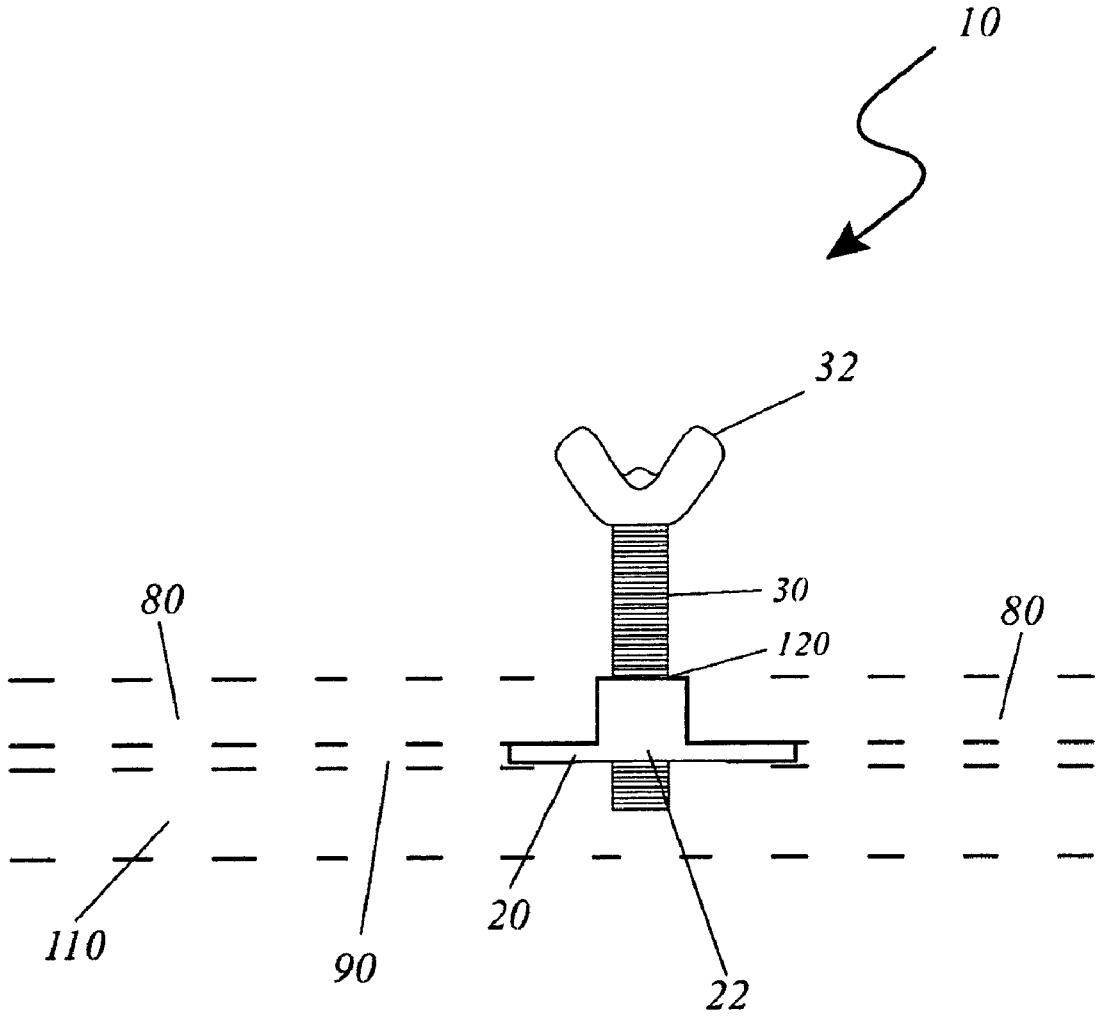

Referring now to FIG. 7, an environmental view of the system, according to the preferred embodiment of the present system, is disclosed. The first spacer disk 20 is located in the adhesive layer 90 on an upper surface of a subfloor 110. The threaded stem 30 is threadably attached thereto the first spacer disk 20 within the spacing gap 120 between the tiles 80.

It is envisioned that all the embodiments of the present system 10, 40, 60 may be introduced in a variety of different sizes depending on the type of flooring material used and the desired spacing gap 120.

It is envisioned that other styles and configurations of the present system can be easily incorporated into the teachings of the present invention, and only one particular configuration shall be shown and described for purposes of clarity and disclosure and not by way of limitation of scope.

The preferred embodiment of the present system can be utilized by the common user in a simple and effortless manner with little or no training. After initial purchase or acquisition of the system, it would be installed as indicated in FIGS. 1, 2, 5, and 7.

The method of utilizing the system may be achieved by performing the following steps: assembling a plurality of first height adjustable tile spacers 10 by threadably attaching the threaded stem 30 thereto the spacer disk 20 insuring assembly is straight and aligned; mixing the adhesive mortar; troweling the adhesive mortar onto a top surface of the subfloor 110 using a notched tile trowel creating an adhesive layer 90; setting a first row of tiles 80 gently onto the adhesive layer 90 but not pressing the tiles 80 in place; inserting the first height adjustable tile spacers 10 on the adhesive layer 90 under the corners of all the tiles 80; setting a second row of tiles 80 gently onto the adhesive layer 90 but not pressing the tiles 80 in place; setting the spacing gap 120 width between adjacent tiles 80 by aligning the corners of the tiles 80 atop the first spacer disk 20 separated by the first spacer tabs 22; leveling the adjacent tiles 80 by turning the threaded stem 30 in a clockwise manner thus vertically raising the spacer disk 20 off of the subfloor 110 by means of extending the lower portion of the threaded stem 30 therethrough the first stem aperture 24 (see FIG. 2); lowering the spacer disk 20 by turning the threaded stem 30 in a counter-clockwise manner; leveling each tile 80 in relation to any other adjacent tile 80 by means of appropriate directional turning of the threaded stems 30 for every first height adjustable tile spacer 10; ensuring all tiles 80 are level with respect to any adjacent tile 80 by means of a surface level; pressing all of the tiles 80 firmly into the adhesive layer 90; cleaning any excess adhesive mortar from the top surface of the tiles 80; repeating the above steps for each successive row of tiles 80 until the flooring area is completely covered with tiles 80; allowing the adhesive mortar to dry for approximately twenty four (24) hours; removing the threaded stems 30 from each first adjustable tile spacer 10 by turning the stem 30 in a counter-clockwise manner thus threadably detaching from the stem aperture 24; leaving the spacer disks 20 under the corner of the tiles 80 in the adhesive mortar permanently; grouting tiled 80 area with an appropriate grouting mixture as normal; and, benefiting from the increased and improved convenience, accuracy, and time efficiency of installing tiles 80, while using the present system.

The method of utilizing an alternate embodiment of the present system may be achieved by performing the same steps provided for in the preferred embodiment of the system but used in particular applications depending upon the orientation of the tiles 80 by placing the second height adjustable tile spacers 40 under the corners of the tiles 80 which come in contact with the baseboard 100.

The method of utilizing an alternate embodiment of the present system may be achieved by performing the same steps provided for in the preferred embodiment of the system but used in particular applications depending upon the staggered orientation of the rectangular tiles 81 by placing the third height adjustable tile spacers 60 under the corners of the tiles 81.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A tile spacer comprising:

a circular disk further comprising:

a stem aperture centrally located in said circular disk and comprising internal threading; and, at least one (1) raised spacer tab comprising an integrally molded raised portion on an upper surface of said circular disk; and, a threaded tubular stem comprising a winged head molded onto an upper end of said threaded tubular stem;

wherein said tile spacer is vertically adjustable and is able to move a tile in a vertical manner to achieve a level tile setting;

wherein said stem aperture threadably receives said threaded tubular stem; and, wherein said at least one (1) spacer tab is adapted to abut against said tile to move said tile in said vertical manner.

2. The tile spacer of claim 1, wherein said tile spacer comprises a rigid plastic material.

3. The tile spacer of claim 2, wherein said circular disk comprises a diameter of about three fourths (¾) inch and a thickness of one eighth (⅛) inch.

4. The tile spacer of claim 3, wherein said threaded stem comprises a width equal to or less than the width of said at least one (1) spacer tab incorporated thereon said tile spacer.

5. The tile spacer of claim 4, further comprising four (4) spacer tabs.

6. The tile spacer of claim 5, wherein said spacer tabs are equidistantly located at ninety degree (90°) angles from each other.

7. The tile spacer of claim 4, further comprising two (2) spacer tabs.

8. The tile spacer of claim 7, wherein said spacer tabs are equidistantly oriented at one hundred and eighty degree (180°) angles from each other.

9. The tile spacer of claim 4, further comprising three (3) spacer tabs.

10. The tile spacer of claim 9, wherein said spacer tabs are oriented in a "T"-shaped configuration.

11. A method of installing and utilizing a tile spacer for vertically adjusting a tile by performing the following steps:

providing said tile spacer comprising:

a circular disk further comprising:

a stem aperture centrally located in said circular disk and comprising internal threading; and, at least one (1) raised spacer tab comprising an integrally molded raised portion on an upper surface of said circular disk; and, a threaded tubular stem comprising a winged head molded onto an upper end of said threaded tubular stem;

wherein said tile spacer is vertically adjustable and is able to move a tile in a vertical manner to achieve a level tile setting;

wherein said stem aperture threadably receives said threaded tubular stem; and, wherein said at least one (1) spacer tab is adapted to abut against said tile to move said tile in said vertical manner;

troweling an adhesive mortar onto a top surface of a subfloor using a notched tile trowel to create an adhesive layer;

lightly applying a first tile onto said adhesive layer;

inserting said tile spacer between said adhesive layer and a corner of said tile;

inserting additional tile spacers under remaining corners of said tile;

lightly applying additional tiles and additional tile spacers onto said adhesive layer so that a tile spacer is located between all applied tiles;

adjusting a spacing gap width between adjacent tiles by aligning the corners of the tiles atop said tile spacer separated by a spacer tab;

leveling adjacent tiles by turning said threaded tubular stem in a clockwise manner;

lowering said tile spacer by turning said threaded tubular stem in a counter-clockwise manner;

leveling said additional tiles in relation to any other adjacent tile by means of appropriate directional turning of said threaded tubular stem for every tile spacer;

verifying that all tiles are level with respect to any adjacent tile by means of a surface level;

pressing all tiles firmly into said adhesive layer;

cleaning any excess adhesive mortar from a top surface of said tiles;

repeating the above steps for each successive row of tiles until a flooring area is completely covered with tiles;

allowing said adhesive mortar to dry for approximately twenty four (24) hours;

removing said threaded tubular stem from each tile spacer by turning said threaded tubular stem in a counter-clockwise manner until detached from said stem aperture;

leaving said circular disk under said corner of each said tile in said adhesive mortar;

grouting tiled area with an appropriate grouting mixture; and, benefiting from an increased and improved convenience, accuracy, and time efficiency of installing tiles using said tile spacer.

12. The method of claim 11, with the additional steps of:

providing a second tile spacer comprising:

a circular disk further comprising:

a stem aperture centrally located in said circular disk and comprising internal threading; and, four (4) spacer tabs each comprising an integrally molded raised portion on an upper surface of said circular disk equidistantly located at ninety degree (90°) angles from each other; and, a threaded tubular stem comprising a winged head molded onto an upper end of said threaded tubular stem;

wherein said tile spacer is vertically adjustable and is able to move a tile in a vertical manner to achieve a level tile setting;

wherein said stem aperture threadably receives said threaded tubular stem; and, wherein said at least one (1) spacer tab is adapted to abut against said tile to move said tile in said vertical manner; and, using said second tile spacer with four (4) spacer tabs when four (4) tile corners are adjacent to each other in a tile setting situation.

13. The method of claim 11, with the additional steps of:

providing a second tile spacer comprising:

a circular disk further comprising:

a stem aperture centrally located in said circular disk and comprising internal threading; and, two (2) spacer tabs each comprising an integrally molded raised portion on an upper surface of said circular disk equidistantly oriented at one hundred and eighty degree (180°) angles from each other; and, a threaded tubular stem comprising a winged head molded onto an upper end of said threaded tubular stem;

wherein said tile spacer is vertically adjustable and is able to move a tile in a vertical manner to achieve a level tile setting;

wherein said stem aperture threadably receives said threaded tubular stem; and, wherein said at least one (1) spacer tab is adapted to abut against said tile to move said tile in said vertical manner; and, using said second tile spacer with two (2) raised spacer tabs when two (2) tiles are adjacent to each other in a tile setting situation.

14. The method of claim 11, with the additional steps of:

providing a second tile spacer comprising:

a circular disk further comprising:

a stem aperture centrally located in said circular disk and comprising internal threading; and, three (3) spacer tabs each comprising an integrally molded raised portion on an upper surface of said circular disk oriented in a "T"-shaped configuration; and, a threaded tubular stem comprising a winged head molded onto an upper end of said threaded tubular stem;

wherein said tile spacer is vertically adjustable and is able to move a tile in a vertical manner to achieve a level tile setting;

wherein said stem aperture threadably receives said threaded tubular stem; and, wherein said at least one (1) spacer tab is adapted to abut against said tile to move said tile in said vertical manner; and, using said second tile spacer with three (3) raised spacer tabs when three (3) tile corners are adjacent to each other in a tile setting situation.

* * * * *